US008946657B2

(12) United States Patent
Apel et al.

(10) Patent No.: US 8,946,657 B2
(45) Date of Patent: Feb. 3, 2015

(54) BEAM HEAD

(75) Inventors: Manfred Apel, Rudolstadt (DE); Clemens Fiebiger, Uttenreuth (DE); Wolfgang Hennig, Rudolstadt (DE); Roland Schmidt, Erlangen (DE); Björn Österreicher, Saalfeld (DE)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 13/264,368

(22) PCT Filed: Apr. 8, 2010

(86) PCT No.: PCT/EP2010/054637

§ 371 (c)(1), (2), (4) Date: Oct. 13, 2011

(87) PCT Pub. No.: WO2010/118982

PCT Pub. Date: Oct. 21, 2010

(65) Prior Publication Data

US 2012/0025106 A1 Feb. 2, 2012

(30) Foreign Application Priority Data

Apr. 14, 2009 (DE) ..... 10 2009 017 3447

(51) Int. Cl.
*G21K 5/00* (2006.01)
*G21K 5/04* (2006.01)

(52) U.S. Cl.
CPC ..... *G21K 5/04* (2013.01)
USPC ..... 250/492.1; 250/492.3

(58) Field of Classification Search
None
See application file for complete search history.

(56) References Cited

U.S. PATENT DOCUMENTS

| | | | | |
|---|---|---|---|---|
| 2,602,751 A | | 7/1952 | Robinson | |
| 2,977,500 A | | 3/1961 | Boeker | |
| 3,605,009 A | * | 9/1971 | Enge | 323/293 |
| 3,752,990 A | * | 8/1973 | Fischer | 378/38 |
| 3,895,254 A | * | 7/1975 | Minamikawa et al. | 315/57 |
| 3,901,285 A | * | 8/1975 | Griffith | 139/441 |
| 4,084,076 A | * | 4/1978 | Istomin et al. | 219/121.27 |
| 4,143,272 A | * | 3/1979 | Frank | 250/425 |

(Continued)

FOREIGN PATENT DOCUMENTS

| | | | | |
|---|---|---|---|---|
| DE | 3901285 A1 | * | 7/1990 | H01F 27/02 |
| DE | 10 2007 042 108 A1 | | 3/2009 | |

(Continued)

OTHER PUBLICATIONS

German Office Action dated Jan. 20, 2010 for corresponding German Patent Application No. DE 10 2009 017 344.7-54 with English translation.

(Continued)

*Primary Examiner* — Andrew Smyth
(74) *Attorney, Agent, or Firm* — Lempia Summerfield Katz LLC

(57) ABSTRACT

The present embodiments relate to a beam head including a vacuum housing, in which an electron source is arranged. The beam head also includes a beam finger that is connected to the vacuum housing and has an outlet window at a distal end. The beam head includes a transformer housing, in which a transformer connected to the electron source is arranged. The transformer housing is arranged directly on the vacuum housing.

13 Claims, 1 Drawing Sheet

(56) References Cited

U.S. PATENT DOCUMENTS

| | | | | |
|---|---|---|---|---|
| 4,492,873 | A * | 1/1985 | Dmitriev et al. | 250/492.3 |
| 4,515,165 | A * | 5/1985 | Carroll | 600/475 |
| 4,574,178 | A * | 3/1986 | Spruck | 219/121.27 |
| 5,060,254 | A * | 10/1991 | de Fraguier et al. | 378/136 |
| 5,118,991 | A * | 6/1992 | Fritz et al. | 315/94 |
| 5,321,271 | A * | 6/1994 | Schonberg et al. | 250/492.3 |
| 5,418,372 | A * | 5/1995 | Schonberg et al. | 250/492.3 |
| 5,558,718 | A * | 9/1996 | Leung | 118/723 E |
| 6,412,979 | B1 * | 7/2002 | Hell et al. | 378/200 |
| 6,426,998 | B1 * | 7/2002 | Hell et al. | 378/141 |
| 6,485,659 | B1 * | 11/2002 | Goedde et al. | 252/570 |
| 6,732,448 | B2 * | 5/2004 | Strzala | 34/92 |
| 7,016,468 | B1 * | 3/2006 | Krema et al. | 378/112 |
| 7,730,879 | B2 * | 6/2010 | Maul et al. | 123/603 |
| 8,277,738 | B2 * | 10/2012 | Kim et al. | 422/186 |
| 2003/0164479 | A1 * | 9/2003 | Goedde et al. | 252/570 |
| 2005/0003669 | A1 * | 1/2005 | Han et al. | 438/691 |
| 2006/0181837 | A1 * | 8/2006 | Sun et al. | 361/602 |
| 2007/0145304 | A1 * | 6/2007 | Roche et al. | 250/493.1 |
| 2007/0283667 | A1 | 12/2007 | Kristiansson et al. | |
| 2008/0073549 | A1 * | 3/2008 | Avnery | 250/397 |
| 2009/0045350 | A1 * | 2/2009 | Humele et al. | 250/455.11 |
| 2009/0058319 | A1 | 3/2009 | Berk et al. | |
| 2009/0139504 | A1 * | 6/2009 | Maul et al. | 123/594 |
| 2010/0141145 | A1 * | 6/2010 | Batz et al. | 315/57 |

FOREIGN PATENT DOCUMENTS

| | | | |
|---|---|---|---|
| EP | 1 982 920 | A1 | 10/2008 |
| JP | 2003307598 | A | 10/2003 |
| WO | WO 98/42385 | | 10/1998 |

OTHER PUBLICATIONS

European Written Report and Search Report dated Jul. 26, 2010 for corresponding PCT/EP2010/054637 with English translation.

* cited by examiner

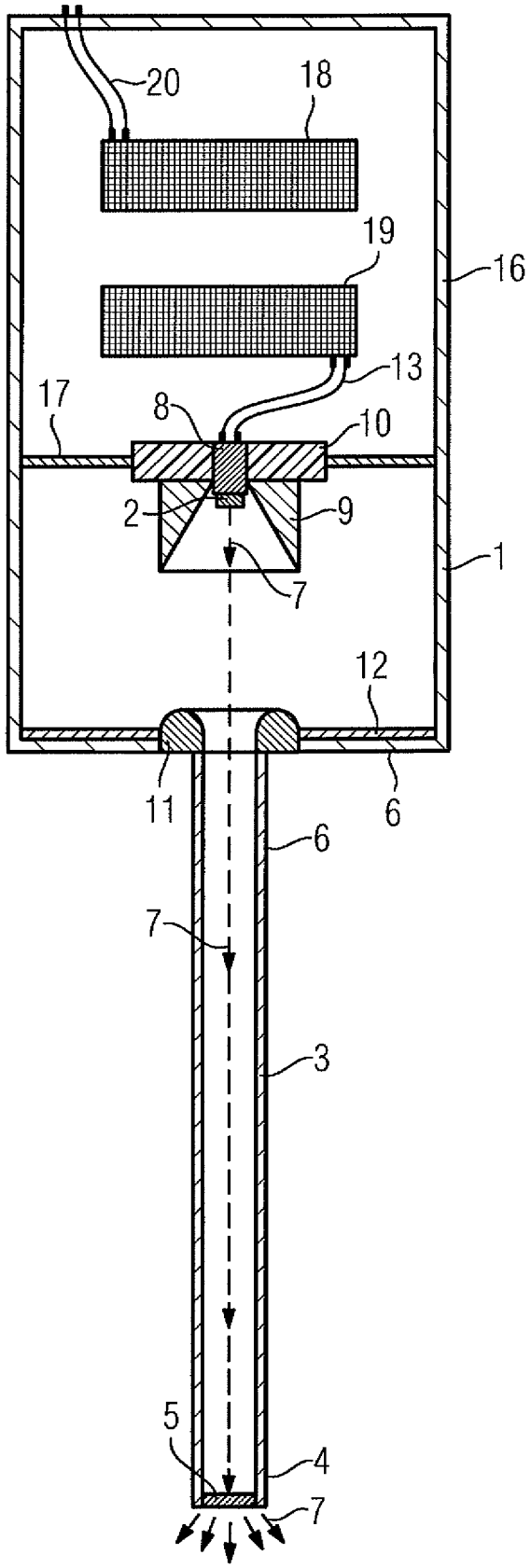
20
18
19
16
13
17
8
10
2
9
1
7
12
11
6
6
7
3
5
4
7

BEAM HEAD

The present patent document is a §371 nationalization of PCT Application Serial Number PCT/EP2010/054637, filed Apr. 8, 2010, designating the United States, which is hereby incorporated by reference. This patent document also claims the benefit of DE 10 2009 017 344.7, filed Apr. 14, 2009, which is also hereby incorporated by reference.

BACKGROUND

The present embodiments relate to a beam head.

Electrons emitted from a beam head serve, for example, for the physical sterilization of packaging materials and containers (e.g., bottles). The electrons are generated in an electron source and are accelerated by application of a high voltage to a defined kinetic energy. Following acceleration, the electrons drift through a beam finger and, after passing through the outlet window, impinge upon a region to be sterilized. The high voltage required for electron production and for electron acceleration is generated in a separate transformer (e.g., a high voltage generator) for each beam head and is fed using a high voltage cable and a suitable high voltage plug-and-socket connection to the relevant beam head.

SUMMARY AND DESCRIPTION

Due to the separate transformer and dedicated transformer housing and a dedicated high voltage cable, the conventional beam head uses, in each case, a correspondingly large structural volume. For use in a beverage filling machine, a design of this type is to be repeated multiple times, so that the resulting relatively large structural size of the beam head is disadvantageous. With this design, the high voltage plug-and-socket connection also represents a weak point with regard to reliability.

The present embodiments may obviate one or more of the drawbacks or limitations in the related art. For example, a beam head that is designed to be compact and has a high degree of operational reliability is provided.

A beam head includes a vacuum housing, in which an electron source is arranged, and a beam finger that is connected to the vacuum housing and has an outlet window at a distal end. The beam head also includes a transformer housing, in which a transformer connected to the electron source is arranged. According to the present embodiments, the transformer housing is arranged directly at the vacuum housing.

With the beam head according to the present embodiments, the vacuum housing and the transformer housing form a common beam head housing. The beam head according to the present embodiments is therefore configured with a single housing.

The beam head according to one embodiment is designed significantly more compactly than a beam head according to the prior art. For a connection between the transformer and the electron source, no high voltage plug-and-socket connection situated outside the beam head housing is required, so that the operational reliability of the beam head according to the present embodiments is increased.

When the beam head with the single-housing configuration is used in a beverage filling machine, the design of the present embodiments enables a plurality of high-voltage cables and high-voltage plug-and-socket connections to be dispensed with. A central control system and a central power supply are provided for all the beam heads of a beverage filling machine.

In one embodiment, the transformer housing is arranged on a side of the vacuum housing remote from the beam finger.

This therefore increases the height and not the width of the beam head. An embodiment of the beam head of this type may be for use in a filling plant.

The transformer housing may be evacuated. Filling of the transformer housing with oil is also possible. As an alternative to electrical insulation using vacuum or oil, the transformer may be filled with a casting compound by filling the transformer housing therewith.

In one embodiment of the beam head, the beam finger has a cross-section that is smaller than the cross-section of the vacuum housing. The cross-section may be matched to an opening of the containers to be sterilized. A beam head of this type may be passed, with the beam finger of the beam head, through the opening of the container, and the majority of the unfocused emergent electrons fall upon an inner wall of the container.

According to an advantageous exemplary embodiment, the vacuum housing and the beam finger are made from stainless steel.

In the beam head according to the present embodiments, the electrons may be generated either by field emission or by thermal emission (e.g., by application of an electric voltage or by laser-induced electron emission). The electron source may be configured as a flat emitter or as an incandescent filament.

In an embodiment of the beam head, the outlet window has a layer thickness of between 10 μm and 20 μm. The electrons emerging from the beam finger consequently suffer only slight losses due to attenuation of the intensity and by scattering.

According to an embodiment, the outlet window is made from titanium (Ti). Titanium has high strength and a relatively low density and in air, forms an extremely resistant oxidic protective layer, making titanium corrosion-resistant in many media.

BRIEF DESCRIPTION OF THE DRAWINGS

FIG. 1 shows one embodiment of a beam head.

DETAILED DESCRIPTION OF THE DRAWINGS

An exemplary embodiment is described below in greater detail making reference to FIG. 1, but without limiting the invention to the exemplary embodiment.

A beam head, which is shown in FIG. 1, includes a vacuum housing 1, in which an electron source 2 and a beam finger 3 that is connected to the vacuum housing 1 are arranged. The beam finger 3 has an outlet window 5 at a distal end 4 (e.g., an outlet aperture). In the embodiment of the beam head shown, the vacuum housing 1 forms, together with the beam finger 3, a permanently hard vacuum-tight vacuum shell 6 that is made, for example, from stainless steel.

In the exemplary embodiment shown, the vacuum shell 6, which is formed from the vacuum housing 1 and the beam finger 2, is, for example, at earth potential, where the electron source 2 arranged in the vacuum housing 1 is at a potential of, for example, between −50 keV and −200 keV. On application of a correspondingly high voltage, electrons 7 emitted by the electron source 2 (e.g., shown in the drawing as a dashed line) are therefore accelerated in a direction of the outlet window 5, which is also at earth potential. After emergence of the electrons 7 from the beam finger 3 (via the outlet window 5), the electrons impinge in unfocused manner on a surface of packaging material or on a surface of a container (not shown in the drawing). The surfaces that are irradiated with the electrons 7 emerging from the outlet window 5 are thereby sterilized.

In the beam head according to the present embodiments, the electrons 7 may be generated either by field emission or by thermal emission (e.g., by application of an electric voltage or by laser-induced electron emission). In the exemplary embodiment shown, the electron source 2 is configured as a cathode (e.g., a flat emitter, an incandescent filament). The cathode 2 is connected via a high voltage connection 8 and a high voltage cable 13 to a transformer 15 (e.g., a high voltage source, a high voltage generator). The transformer 15 includes a primary winding 18, a secondary winding 19, and a current supply cable 20. Further details of the transformer 15 are not shown for reasons of clarity.

The transformer 15 is arranged in a transformer housing 16 that is arranged directly at the vacuum housing 1.

In the beam head according to the present embodiments, the vacuum housing 1 and the transformer housing 16 form a common beam head housing. The beam head according to the present embodiments is therefore configured with a single housing.

The beam head according to the present embodiments is constructed substantially more compactly compared with a beam head according to the prior art. In addition, no high voltage plug-and-socket connector situated outside the beam head housing is necessary for a connection between the transformer 15 and the electron source 2 (cathode), so that operational reliability is increased with the beam head according to the present embodiments.

When the beam head with a single housing design is used in a beverage filling machine, a plurality of high voltage cables and high voltage plug-and-socket connections may be dispensed with due to the design of the present embodiments. For all the beam heads of a beverage filling machine, central control and a central power supply are provided.

According to the embodiment shown, the transformer housing 16 is arranged directly on a side 17 of the vacuum housing 1 remote from the beam finger 3. The result is that the beam head housing is extended in the height and not the width. Such an embodiment of the beam head may be for use in a filling plant.

The cathode 2 is also cylindrically surrounded by a Wehnelt cylinder 9 (e.g., a control electrode with negative voltage applied) that focuses the electrons 7 emerging from the cathode 2 into an electron beam.

The cathode 2, the high voltage connection 8 and the Wehnelt cylinder 9 are mechanically fastened in the vacuum housing 1 via an insulator 10 at the side 17 remote from the beam finger 3.

The transition from the vacuum housing 1 to the beam finger 3 (e.g., a region, at which the electron beam 7 emerges from the vacuum housing 1 and enters the beam finger 3) is protected against discharge effects, arcing, and consequent deterioration of the quality of the electron beam 7 by a corona ring 11. The constriction of the electric field prevents field peaking, so that the high voltage strength and thus the high voltage protection are provided. The arrangement of the corona ring 11 significantly increases a radius of curvature in the region of transition from the vacuum housing 1 to the beam finger 3 and therefore reliably prevents a sharp-edged transition that would lead to field peaking.

The corona ring 11 also, as far as possible, prevents any fanning out of the electron beam 7 on a route to the outlet window 5 before entry of the electrons 7 into the beam finger 3. The corona ring 11 therefore also acts as a focusing ring. Electrons 7 that are possibly not focused are collected on an anode plate 12 arranged on the inside of the vacuum housing 1 adjacent to the beam finger 3.

In the beam head shown in FIG. 1, the beam finger 3 has a cross-section that is smaller than the cross-section of the vacuum housing 1. The cross-section may be matched to an opening of a container to be sterilized. A beam head of this type may be fed through the opening of the container, and the emerging electrons 7 may impinge on an inner wall of the container.

In the embodiment of the beam head shown in FIG. 1, the outlet window 5 is made from titanium (Ti) and has a layer thickness of between 10 μm and 20 μm. As a result, electrons emerging from the beam finger 3 suffer only slight losses through attenuation of the intensity and through scattering.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. A beam head comprising:

a vacuum housing, in which an electron source is arranged;

a beam finger that is connected to the vacuum housing, the beam finger comprising an outlet window at a distal end; and a high voltage transformer housing, in which a high voltage transformer connected to the electron source is arranged via a high voltage transformer connection, wherein the high voltage transformer housing is arranged directly on a side of the vacuum housing such that the high voltage transformer housing and the vacuum housing share a common dividing wall and form a common beam head housing, and the high-voltage transformer connection to the electron source is entirely inside the common beam head housing.

2. The beam head as claimed in claim 1, wherein the high voltage transformer housing is arranged at a side of the vacuum housing remote from the beam finger.

3. The beam head as claimed in claim 1, wherein the high voltage transformer housing is evacuated.

4. The beam head as claimed in claim 1, wherein the high voltage transformer housing is filled with oil.

5. The beam head as claimed in claim 1, wherein the high voltage transformer housing is filled with a casting compound.

6. The beam head as claimed in claim 1, wherein the beam finger has a cross-section that is smaller than a cross-section of the vacuum housing.

7. The beam head as claimed in claim 1, wherein the vacuum housing and the beam finger are made from stainless steel.

8. The beam head as claimed in claim 1, wherein the electron source is configured as a flat emitter.

9. The beam head as claimed in claim 1, wherein the electron source is configured as an incandescent filament.

10. The beam head as claimed in claim 1, wherein the outlet window has a layer thickness of between 10 μm and 20 μm.

11. The beam head as claimed in claim 1, wherein the outlet window is made from titanium.

12. The beam head as claimed in claim 1, wherein the high voltage transformer housing is arranged at a side of the vacuum housing furthest from the beam finger.

13. The beam head as claimed in claim 1, wherein the high voltage transformer housing is arranged directly on a side of the vacuum housing opposite the beam finger such that the high voltage transformer housing, the vacuum housing, and the beam finger share a common axis, wherein the common beam head housing has a height measured along the common axis and a width measured perpendicular to the common axis, and wherein a maximum width of the high voltage transformer housing is the same as (1) a maximum width of the vacuum housing and (2) a maximum width of the beam head.

* * * * *